US011058231B2

(12) United States Patent
Missurini et al.

(10) Patent No.: US 11,058,231 B2
(45) Date of Patent: Jul. 13, 2021

(54) EXTENSIBLE MAGAZINE FOR A DISPOSABLE CUP DISPENSER

(71) Applicant: Spring Venture Investment Corp., Doral, FL (US)

(72) Inventors: Luciano Missurini, Sáo Bernardo do Campo (BR); Mauro Moreira de Lima, Mauá (BR)

(73) Assignee: Spring Venture Investment Corp., Doral, FL (US)

( * ) Notice: Subject to any disclaimer, the term of this patent is extended or adjusted under 35 U.S.C. 154(b) by 0 days.

(21) Appl. No.: 16/813,956

(22) Filed: Mar. 10, 2020

(65) Prior Publication Data

US 2021/0052086 A1 Feb. 25, 2021

(30) Foreign Application Priority Data

Aug. 22, 2019 (BR) ..... 20 2019 017485 0

(51) Int. Cl.
*A47F 1/08* (2006.01)

(52) U.S. Cl.
CPC ..... *A47F 1/085* (2013.01)

(58) Field of Classification Search
CPC ..... A47F 1/085
See application file for complete search history.

(56) References Cited

U.S. PATENT DOCUMENTS 5,738,246 A * 4/1998 Chung ..... B65G 59/107 221/222
7,055,234 B2 * 6/2006 Roethel ..... A47F 1/065 29/413
2009/0057334 A1 * 3/2009 Pearl ..... A47F 1/085 221/307

FOREIGN PATENT DOCUMENTS

BR PI 1002856-0 A2 4/2012

* cited by examiner

*Primary Examiner* — Gene O Crawford
*Assistant Examiner* — Ayodeji T Ojofeitimi
(74) *Attorney, Agent, or Firm* — Collard & Roe, P.C.

(57) ABSTRACT

A disposable cup dispenser has an assembly made of thermoplastic material or another material of equivalent characteristics, the disposable cup dispenser being made of a laminar structure comprising a lower base, an upper closure lid, and a magazine formed by a set of modular elements, which can be fitted together vertically. Each modular element has a thin laminar structure, and one of the ends is provided with a uniform enlargement strip that is deployed to receive the end opposite the enlargement strip of another modular element.

3 Claims, 5 Drawing Sheets

EXTENSIBLE MAGAZINE FOR A DISPOSABLE CUP DISPENSER

CROSS-REFERENCE TO RELATED APPLICATIONS

This application claims priority under 35 USC 119 of Brazilian Application No. BR 20 2019 017485 0, the disclosure of which is herein incorporated by reference.

BACKGROUND OF THE INVENTION

1. Field of the Invention

The present application relates to a holder in the field of dispensers of disposable products or cups. In particular, the invention relates to a new tubular element, developed in particular to allow a single cup holder to have a greater or lesser number of units being dispensed as needed. The present patent application is designed to facilitate the refilling of disposable cup dispensers by extending the cup magazine, increasing its holding capacity and thereby minimizing the number of refillings of said holder.

2. The Prior Art

The prior art contains many disposable cup dispensers designed to organize and dispense cups for use by users, the most simple designs being made from single tubular elements having at their lower end an opening to receive, by inertia, a cup unit for its use.

Generally, the vast majority of the models have a major concern regarding the mechanical movement utilized to dispense a cup, so that this prior model, despite its low cost, has a drawback when removing a cup unit, since when pushed down to remove the unit from the tubular magazine, at least one other unit is improperly removed along with it from the dispenser, and since this unit has been handled, it is discarded as being used, causing losses to the company.

Other more sophisticated models of cup dispensers provided with more complex formal structures of high manufacturing cost are equipped with manual mechanisms, making it possible for a single cup to be moved whenever the device is operated. In this model, a movable laminar element is provided, having an opening designed according to the diameter of the cup being provided.

The prior art likewise shows a design of a cup holder filed with the Brazilian Intellectual Property Office INPI as No. PI1002856-0 on 30 Aug. 2010, entitled "DISPOSABLE CUP DISPENSER," specifying a design solution providing the user with greater practicality and reliability of use, which factors make it completely different from the models of the prior art up to that time, being developed with the purpose of allowing the removal of only one disposable cup, operating in an innovative manner with regard to its releasing mechanism. This device has a cup dispenser composed of a storage tube, at least two cup holding tabs, a support, and an external manipulator provided with pivoting cams articulated on axles.

SUMMARY OF THE INVENTION

The present invention has the object to provide more benefits to the consumer market, by providing an extensible magazine for a disposable cup dispenser. This device is distinguished entirely from others of its kind on the consumer market by having a disposable cup magazine made of thermoplastic material or another material of equivalent characteristics, being made of a laminar structure comprising a lower base, a group of modular elements, and an upper closure lid which can be fitted together vertically. This assembly forms a disposable cup dispenser.

BRIEF DESCRIPTION OF THE DRAWINGS

Accompanying the present specification, in order to better understand the characteristics of the invention in accordance with a preferred embodiment thereof, is a set of drawings, enclosed, showing the following in an exemplary but not limiting fashion.

DETAILED DESCRIPTION OF THE INVENTION

Figure 1:
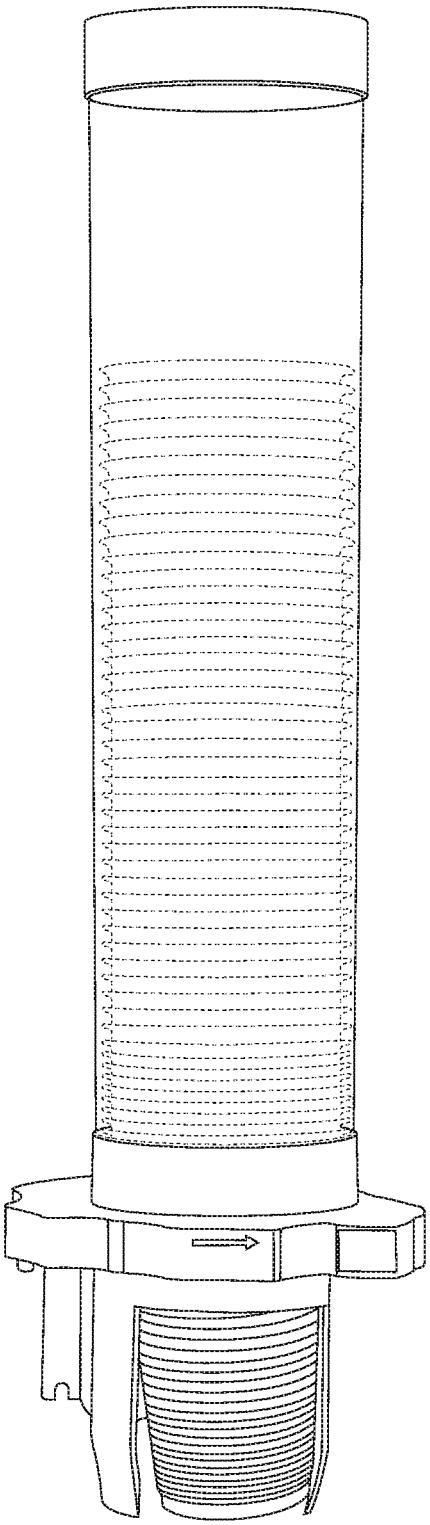
FIG. 1 (PRIOR ART)
FIG. 1 shows a perspective view of a cup holder of the prior art, illustrating the magazine made as a single piece.
Figure 2:
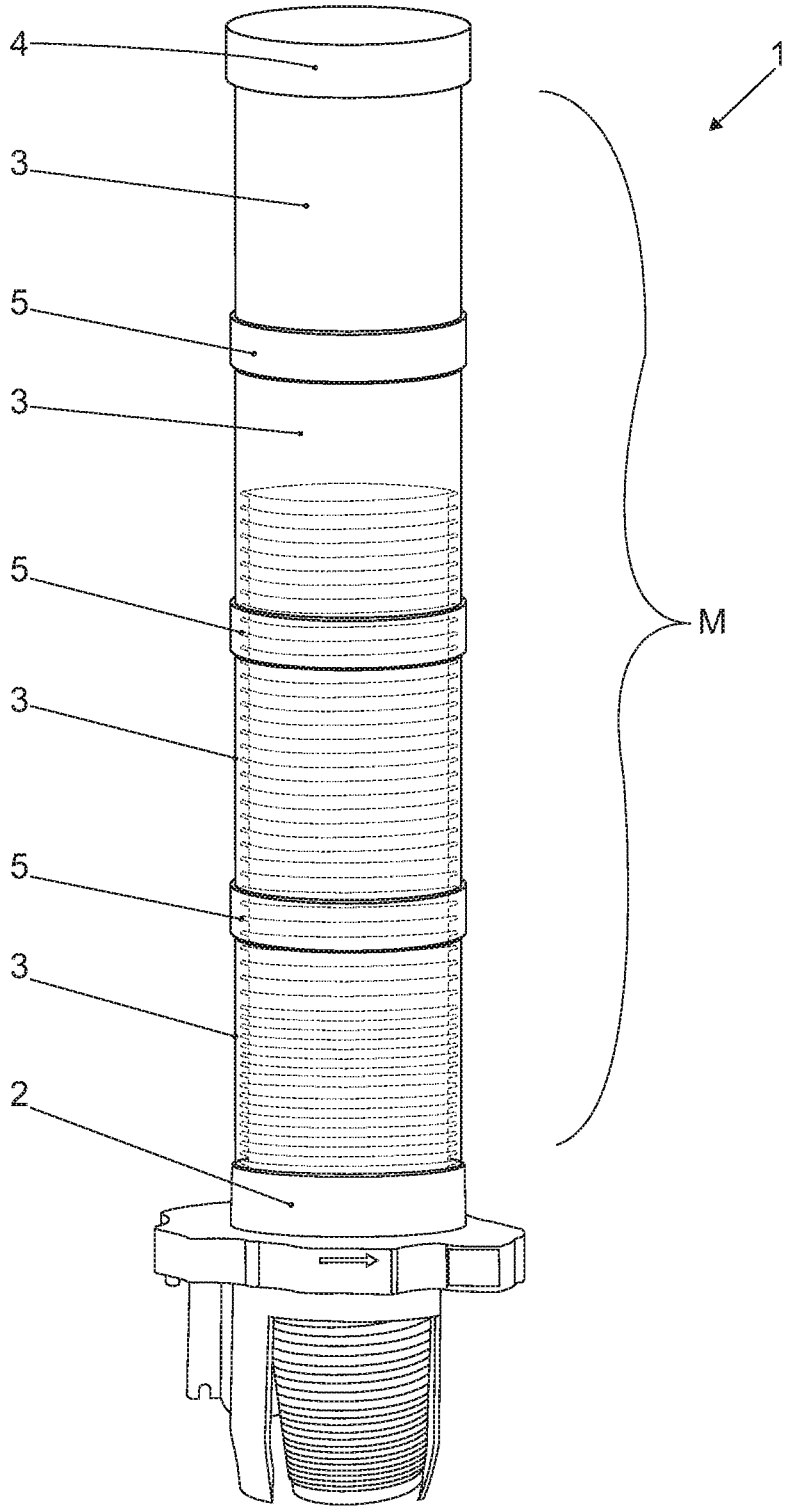
FIG. 2 shows a perspective view of a cup holder according to the invention, revealing an assembly of modular elements producing the extensible magazine which is the subject of this patent.
Figure 3:
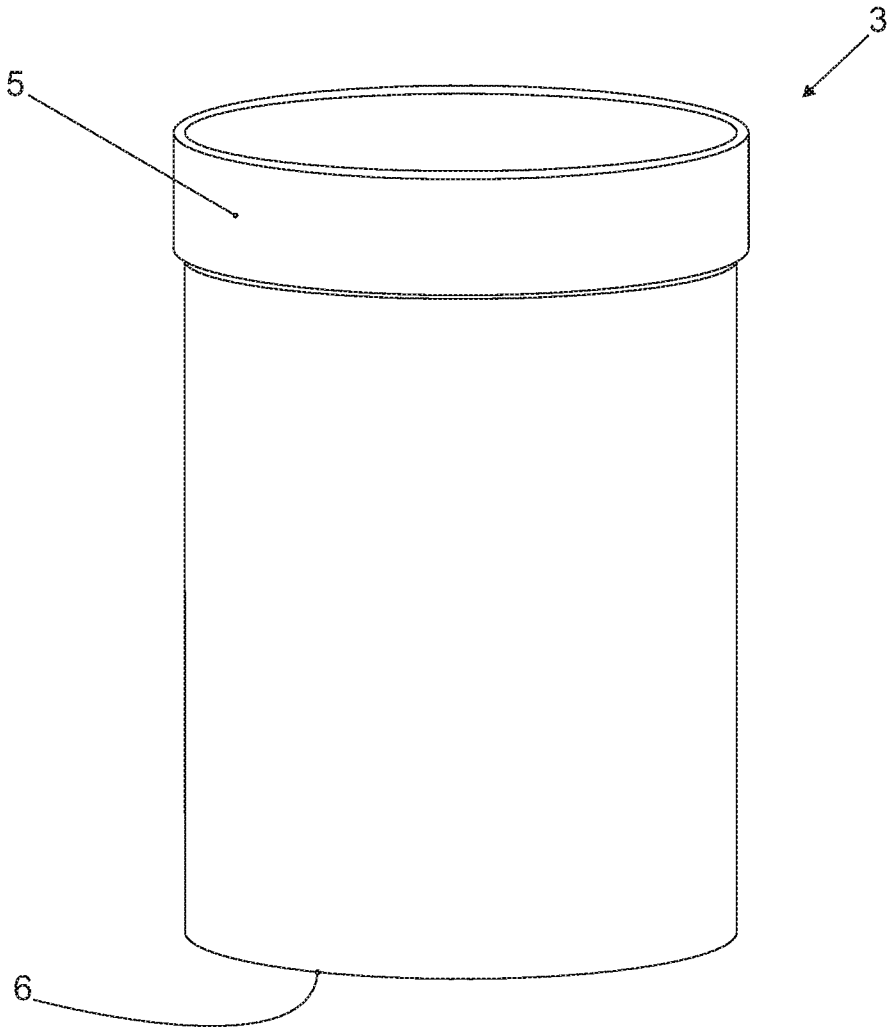
FIG. 3 shows a perspective view of a modular element of the extensible magazine.
Figure 4:
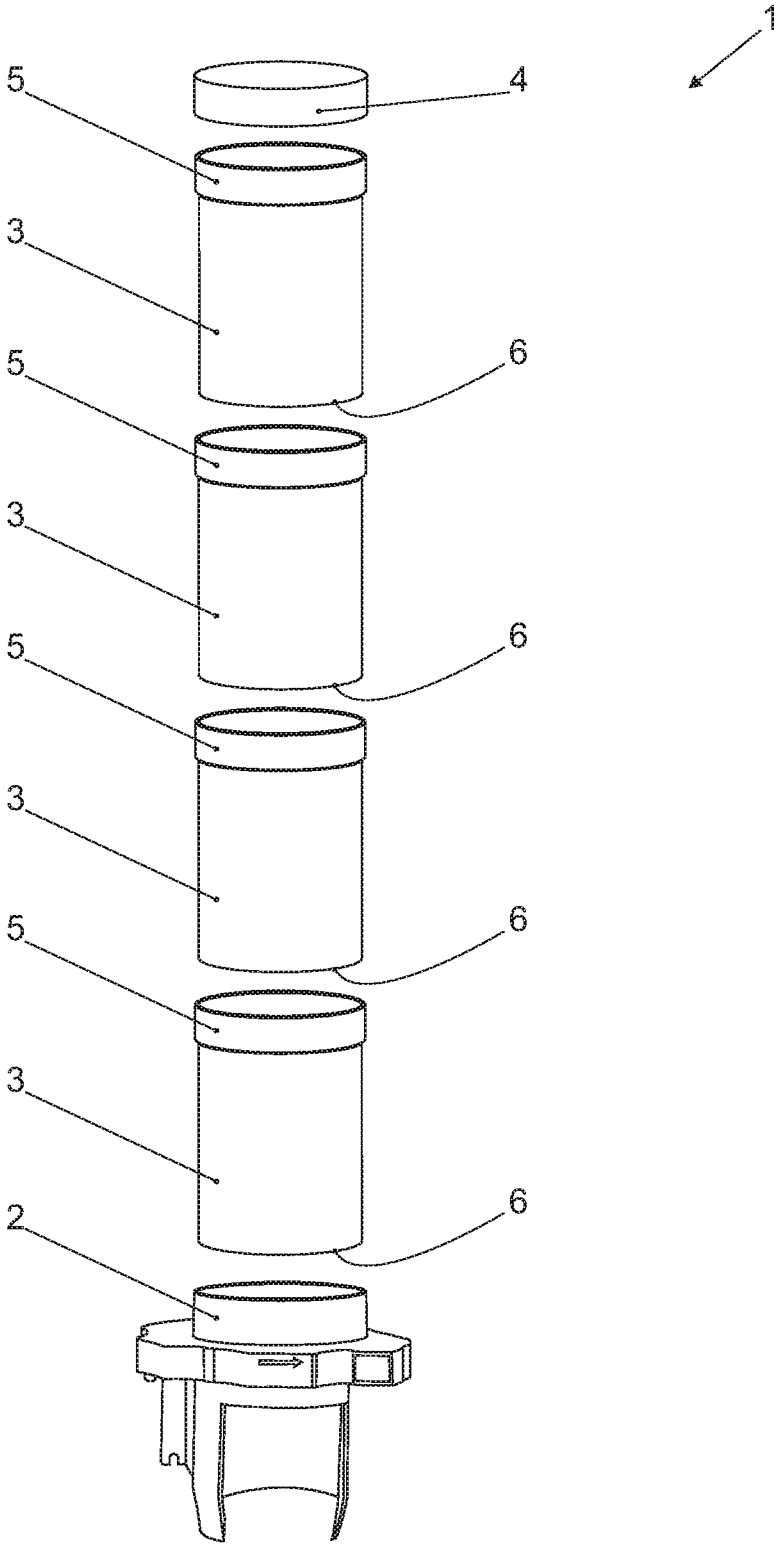
FIG. 4 shows a perspective exploded view of an assembly of modular elements making up the extensible magazine.
Figure 5:
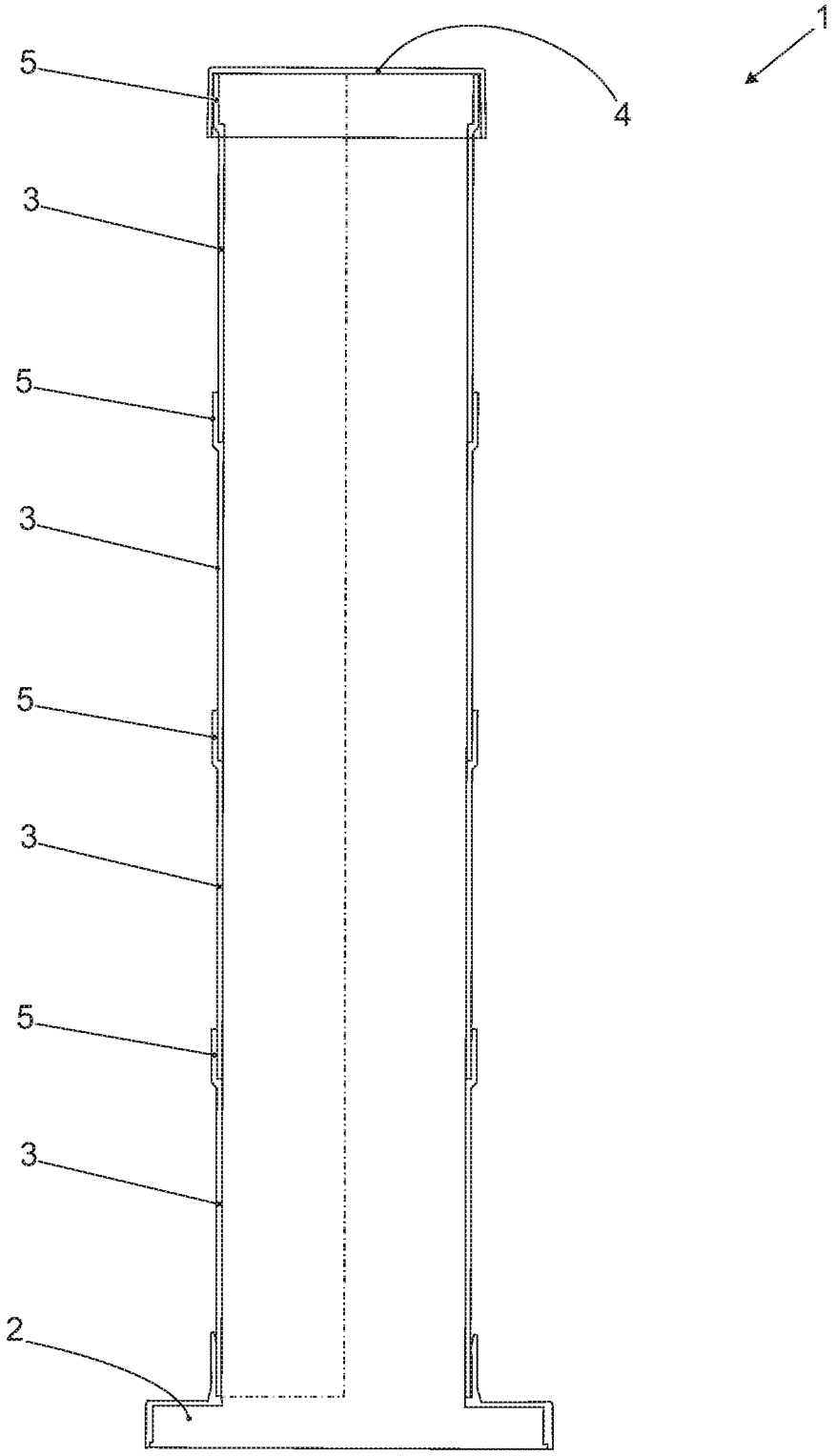
FIG. 5 shows a lateral view, in cross section, of a plurality of modular elements fitted together.

As illustrated by the aforementioned figures, the present invention has an assembly made of thermoplastic or flexible material, or another material of equivalent characteristics, having a disposable cup dispenser 1 being made of a laminar structure and comprising a lower base 2, a set of modular elements 3 which can be fitted together, and an upper closure lid 4 for protection of the cups. This assembly comprises the disposable cup dispenser 1.

The lower base 2 has an internal wall equipped with a peripheral relief contour, designed to contain the first modular element of the magazine M and the other elements afterwards.

This patent application is characterized in having a plurality of modular elements 3 which can be fitted together, each of them having a preferably cylindrical or other related format, possibly having a prismatic format with a rectangular or quadrangular base, having rounded corners, or another regular format suited to being fitted together, of thin laminar structure, with one of the ends having a uniform enlargement strip 5, said enlargement strip 5 being designed to allow the inserting of the end 6 opposite the enlargement strip 5 of another modular element 3.

In this way, each modular element 3 of the magazine M has a cylindrical tubular shape, providing one end having an enlargement strip 5, able to receive the end 6 opposite the enlargement strip 5 of another modular element 3, extending the magazine M to the extend needed by the necessary quantity of cups to be stored there for consumption.

Although the preferred embodiment of the invention is described, any modifications and/or changes should be included within the scope of the invention, falling entirely within the criteria defining it, that is, the combination and modification of elements already known in a new form or arrangement, resulting in a functional improvement in its use or its fabrication.

What is claimed is:

1. An extensible magazine made of a laminar structure and configured for insertion into a disposable cup dispenser having a lower base and an upper closure lid, the magazine comprising a set of modular elements, the modular elements being configured to be fitted together vertically, wherein the modular elements have a thin laminar structure, wherein one end of each modular element is provided with a uniform enlargement strip that extends beyond a width of each said modular element, said enlargement strip being configured to receive an opposite end of another one of the modular elements so that the enlargement strip fits over the opposite end of the another one of the modular elements.

2. The extensible magazine according to claim 1, wherein the modular elements are circular in cross-section.

3. The extensible magazine according to claim 1, wherein the modular elements have a prismatic structure with a quadrangular or rectangular base having rounded corners.

* * * * *